US007657994B2

(12) United States Patent
Snider et al.

(10) Patent No.: US 7,657,994 B2
(45) Date of Patent: Feb. 9, 2010

(54) METHOD FOR INSTALLING A SWITCH PAD

(75) Inventors: Chris R. Snider, Kokomo, IN (US); Mark A. Gill, Russiaville, IN (US)

(73) Assignee: Delphi Technologies, Inc., Troy, MI (US)

( * ) Notice: Subject to any disclaimer, the term of this patent is extended or adjusted under 35 U.S.C. 154(b) by 137 days.

(21) Appl. No.: 11/253,515

(22) Filed: Oct. 19, 2005

(65) Prior Publication Data

US 2007/0084044 A1 Apr. 19, 2007

(51) Int. Cl.
*H01H 11/00* (2006.01)
*H01H 13/52* (2006.01)

(52) U.S. Cl. ..... 29/622; 29/832; 200/512

(58) Field of Classification Search ..... 29/622, 29/832, 830, 876, 881, 743; 200/510, 511, 200/83 N, 5 A, 5 R, 16 R, 16 A, 16 B, 16 C, 200/16 D, 16 F, 512–517, 238–292
See application file for complete search history.

(56) References Cited

U.S. PATENT DOCUMENTS 2,049,531 A * 8/1936 White ..... 200/83 N
4,033,030 A * 7/1977 Robinson et al. ..... 29/622
4,136,269 A * 1/1979 Weidler ..... 200/535
4,491,702 A 1/1985 Kato
4,605,828 A 8/1986 Gostomski
4,634,818 A * 1/1987 Hayes-Pankhurst et al. . 200/5 A
4,980,522 A * 12/1990 Murakami et al. ..... 200/5 A
5,252,916 A * 10/1993 Swart ..... 324/757
6,396,128 B1 5/2002 Inata
6,971,429 B2 * 12/2005 Keil et al. ..... 156/382
7,022,929 B1 * 4/2006 Snider ..... 200/512

FOREIGN PATENT DOCUMENTS

WO WO03/097322 11/2003

OTHER PUBLICATIONS

EP Search Report dated Feb. 22, 2007.
International Search Report dated Apr. 9, 2008.

* cited by examiner

*Primary Examiner*—A. Dexter Tugbang
*Assistant Examiner*—Livius R Cazan
(74) *Attorney, Agent, or Firm*—Jimmy L. Funke

(57) ABSTRACT

Methods and apparatuses are disclosed for assembling a first component, such as a switch pad, to a second component, such as a circuit board.

8 Claims, 8 Drawing Sheets

METHOD FOR INSTALLING A SWITCH PAD

TECHNICAL BACKGROUND

The present invention relates to methods and apparatus for assembling a first component, such as a switch pad, and a second component, such as a circuit board, and in particular for assembling an alignment feature of a switch pad to an alignment aperture of a circuit board.

BACKGROUND OF THE INVENTION

Switch pads are used on many products including electronic control panels for consumer and automotive assemblies. Referring to FIG. 1A, a portion of a switch pad 100 and a circuit board 108 are shown. As is well known, switch pad 100 is made from a flexible material, such as silicon rubber. Switch pad 100 illustratively includes a switch dome 102. Typically, switch pad 100 contains a plurality of switch domes. Each switch dome 102 includes a conductive member 104, illustratively a carbon pill. Conductive member 104 is positioned generally above a corresponding switch contact 106 on circuit board 108 and below a button or actuator 110 which is generally laterally held in place relative to switch dome 102. Switch contact 106 includes a first switch member 112A and a second switch member 112B not in electrical contact with first switch member 112A.

In the absence of an external force, switch dome 102 is generally positioned as shown in FIG. 1A. In this arrangement conductive member 104 is spaced apart from switch contact 106 on circuit board 108. When conductive member 104 is spaced apart switch contact 106 is in an open circuit configuration because first switch member 112A and second switch member 112B are not in electrical contact. In operation, a user typically depresses button 110 in a direction 114 which causes button 110 to collapse switch dome 102 and bring conductive member 104 into electrical contact with both the first switch member 112A and the second switch member 112B of switch contact 106 thereby creating a closed circuit configuration. This closed circuit configuration is interpreted by a controller (not shown) that the user is requesting a certain operation, such as selecting a radio station or adjusting a parameter of a heating/cooling system of a vehicle.

Once the external force in direction 114 is removed, switch dome 102 biases button 110 in direction 118 such that switch pad 100 returns to the configuration shown in FIG. 1A. Switch dome 102 includes a top portion 120 which conductive member 104 is coupled to and a flexible side portion 122 which biases top portion 120 of switch dome 102 in direction 118 and is collapsible when button 110 is moved in direction 114.

Typically switch pad 100 interacts with multiple buttons 110 which cover multiple switch domes 102. Further, each button 110 may cover multiple switch domes 102. The multiple switch domes 102 are interconnected with a flexible base member 124. The flexibility of switch pad 100 allows switch pad 100 to function as described above. However, the flexible nature of switch pad 100 also creates difficulties in assembling switch pad 100 to circuit board 108 resulting in a misalignment of conductive member 104 and switch contact 106.

To align conductive member 104 of switch dome 102 with the corresponding switch contact 106, it is known to use a push-through detail 130 (FIG. 1A) or a pull-through detail 140 (FIG. 1B) to prevent or minimize the lateral movement of switch pad 100 relative to circuit board 108. Often a plurality of push-through details 130 and/or pull-through details 140 are used to stabilize switch pad 100 to prevent undesirable movement of switch pad 100 which could result in misalignment of conductive member 104 and switch contact 106.

The push-through details 130 or pull-through details 140 added to switch pad 100 secure switch pad 100 to circuit board 104. Referring to FIG. 1A, push-through detail 130 has a generally arrow-shaped detail 132 having a diameter greater than the diameter of a corresponding aperture 109 in circuit board 108 and a reduced diameter portion 133 generally equal to or less than a diameter of corresponding aperture 109 in circuit board 108. Detail 132 includes lead-in surfaces 134 to assist in the advancement of push-through detail 130 into corresponding aperture 109 in circuit board 108. Push-through detail 130 further includes a recess 138 accessible from a top surface 139 of switch pad 100 to permit the use of a small diameter rod to enable pushing push-through detail 130 through corresponding aperture 109 in circuit board 108 to allow push-through detail 130 to clear a bottom side 111 of circuit board 108.

Referring to FIG. 1B, pull-through detail 140 has a generally tapered cylindrical detail 142 and a central portion 144 generally equal to a diameter of corresponding aperture 109 in circuit board 108. Detail 142 is generally extra long to permit a tool to grip the detail from bottom side 111 of circuit board 108 to assist in the advancement of pull-through detail 140 into corresponding aperture 109 in circuit board 108. Pull-through detail 140 further includes a recess 146 accessible from a top surface 139 of switch pad 100 to permit the use of a small diameter rod to enable pushing pull-through detail 140 through corresponding aperture 109 in circuit board 108.

The manual assembly of switch pad 100 and circuit board 108 is both time consuming and results in quality control problems because the operator may skip assembling one or more details 130, 140 to corresponding apertures 109 in circuit board 108 or may fail to fully seat one or more details 130, 140 to corresponding apertures 109 in circuit board 108.

Circuit boards 108 are currently tested for electrical component presence with an in-circuit tester unit which utilizes a vacuum attachment to pull circuit board 108 down enabling conductors on the in-circuit tester to touch specific areas on circuit board 108 as a check of electrical component presence. Circuit board 108 is supported by in-circuit tester with a moveable holder which is placed over distributed coil springs and bumpers. The holder is custom designed to correspond to the circuit board being tested.

As a vacuum is drawn the holder moves downward resulting in conductors of the in-circuit tester touching the specific areas of circuit board 108. The bumpers provide a hard stop for the movement of the holder during a vacuum draw. Further, the in-circuit tester may be used with a computer which is programmed to test for the presence of components on circuit board 108 with the in-circuit tester, including providing an indication whether the tested for components are present on circuit board 108 or not present.

An exemplary in-circuit tester is Model No. Z18 XX series available from Terradyne located at Walnut Creek, Calif. An exemplary custom holder is available from Circuit Check located at Maple Groove, Minn. Additional exemplary in-circuit testers are available from Agilent formerly Hewlett-Packard located at Palo Alto, Calif. Additional exemplary custom holders are available from Everett Charles located at Pomona, Calif. and World Test located at Waynesboro, Va.

SUMMARY OF THE INVENTION

The present invention provides a method and an apparatus for assembling a first component including one or more alignment features, such as a switch pad, to a second component including one or more alignment apertures, such as a circuit board.

In an exemplary embodiment of the present invention, a method of assembling a first component and a second component is provided. The method comprising the steps of: providing a flexible first component including a first portion moveable between a first position and a second position and at least one flexible alignment feature and a second component including a predefined portion and at least one alignment aperture through the second component. The flexible alignment feature of the first component and the alignment aperture of the second component cooperate to register the first portion of the flexible first component relative to the predefined portion of the second component. The method further comprising the steps of substantially aligning the flexible alignment feature and the alignment aperture wherein the flexible alignment feature is positioned at least proximate to the alignment aperture relative to a first side of the second component; and generating a pressure difference between the first side of the second component and a second side of the second component at least proximate to the at least one alignment aperture thereby fully seating the flexible alignment feature relative to and the alignment aperture.

In another exemplary embodiment of the present invention, a method of determining whether a switch pad is properly assembled to a circuit board is provided. The switch pad including a plurality of alignment features which are received in a plurality of alignment apertures of the circuit board. The method comprising the steps of: generating a pressure difference between a first side of the circuit board adjacent the switch pad and a second side of the circuit board; and monitoring the pressure adjacent the second side of the circuit board to determine whether the switch pad is properly assembled to the circuit board, wherein when the switch pad is properly assembled to the circuit board a first pressure is observed and when the switch pad is misaligned relative to the circuit board a second pressure is observed, the second pressure being greater than the first pressure.

In a further exemplary embodiment of the present invention, an apparatus for installing a switch pad having a plurality of alignment features on a circuit board having a plurality of alignment apertures is provided. The plurality of alignment features being substantially aligned with the plurality of alignment apertures. The apparatus comprising: a holder configured to support the circuit board, the holder including a plurality of alignment apertures which generally are in fluid communication with the plurality of alignment apertures in the circuit board when the circuit board is positioned on the holder; a pressure source configured to reduce the pressure adjacent a second side of the circuit board positioned adjacent the holder relative to a first side of the circuit board adjacent the switch pad; and a controller operably coupled to the pressure source, the controller executing instructions to activate the pressure source resulting in the movement of the plurality of alignment features towards the second side of the circuit board relative to the first side of the circuit board.

In still a further exemplary embodiment of the present invention, a computer readable medium is provided. The computer readable medium providing instructions for directing a controller to: activate a pressure source to assemble a switch pad to a circuit board resulting in a reduction in a pressure adjacent a second side of the circuit board relative to a first side of the circuit board adjacent the switch pad and causing a plurality of alignment features of the switch pad to move through a plurality of alignment apertures of the circuit board; and determine if the assembly of the switch pad to the circuit board is successful.

In yet another exemplary embodiment of the present invention, a method of assembling a switch pad to a circuit board is provided. The switch pad including a plurality of alignment features which are received in a plurality of alignment apertures of the circuit board. The method comprising the steps of: substantially aligning the plurality of alignment features to the respective plurality of alignment apertures; and advancing the plurality of alignment features through the respective alignment apertures simultaneously.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Figure 1A:
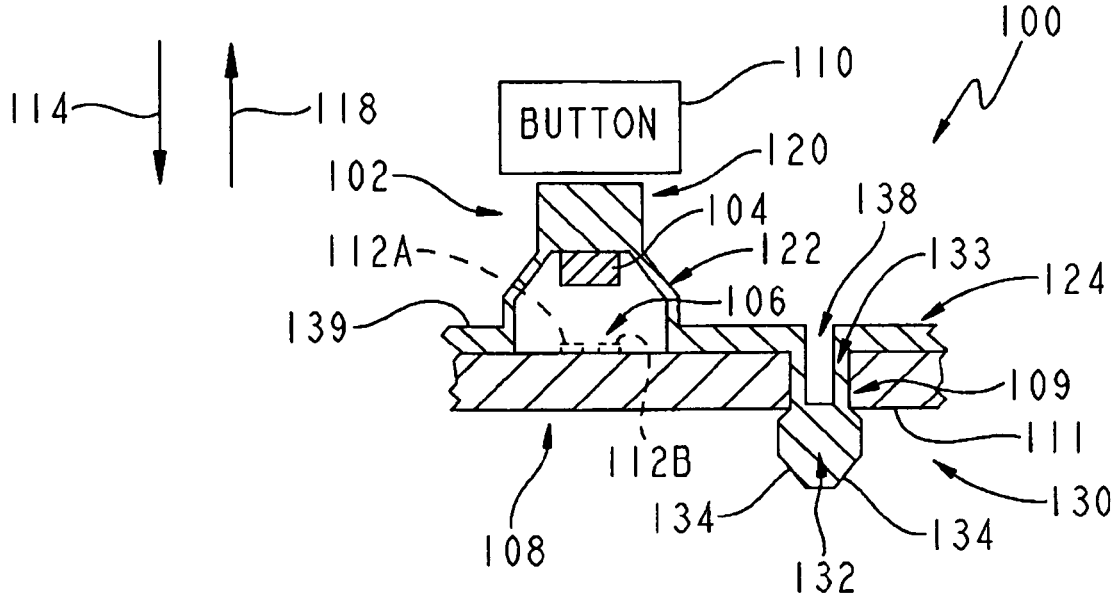
FIG. 1A Prior Art
FIG. 1A is a representative view of a portion of an assembly of a circuit board and a switch pad, the switch pad including a switch dome and a push-through detail.
Figure 1B:
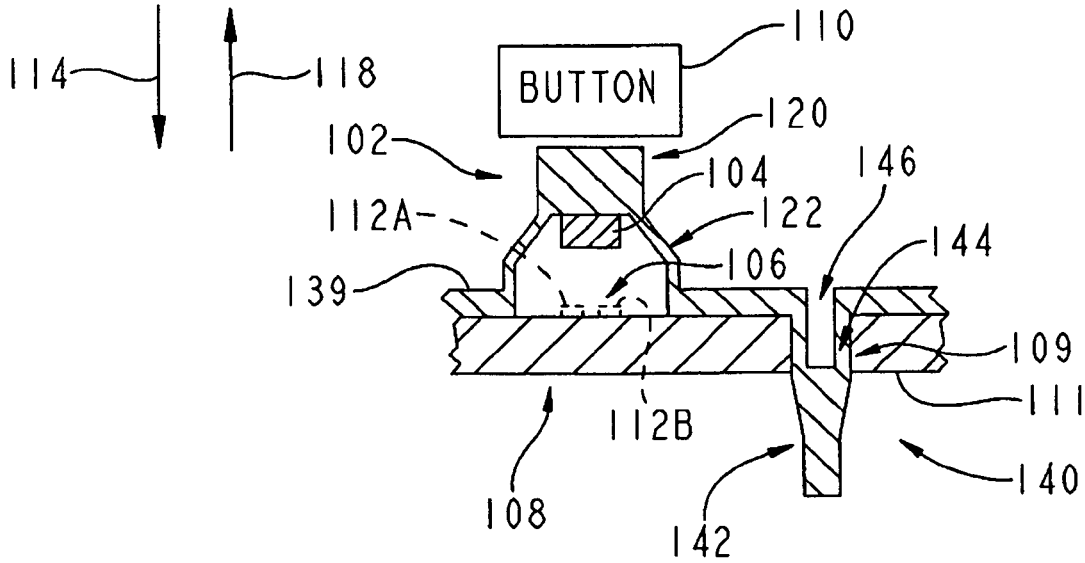
FIG. 1B Prior Art
FIG. 1B is a representative view of a portion of an assembly of a circuit board and a switch pad, the switch pad including a switch dome and a pull-through detail.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms and such exemplification is not to be construed as limiting the scope of the invention in any manner.

DESCRIPTION OF INVENTION

The embodiments discussed below are not intended to be exhaustive or limit the invention to the precise forms disclosed in the following detailed description. Rather, the embodiments are chosen and described so that others skilled in the art may utilize their teachings.

The present disclosure discloses various methods and apparatuses for assembling a first component 200, illustratively a switch pad 202, to a second component 203, illustratively a circuit board 204. Although the present disclosure illustrates various methods and apparatuses for assembling a switch pad 202 to a circuit board 204 the disclosed methods and apparatuses may be used to assemble various additional first components and second components.

Figure 2A:
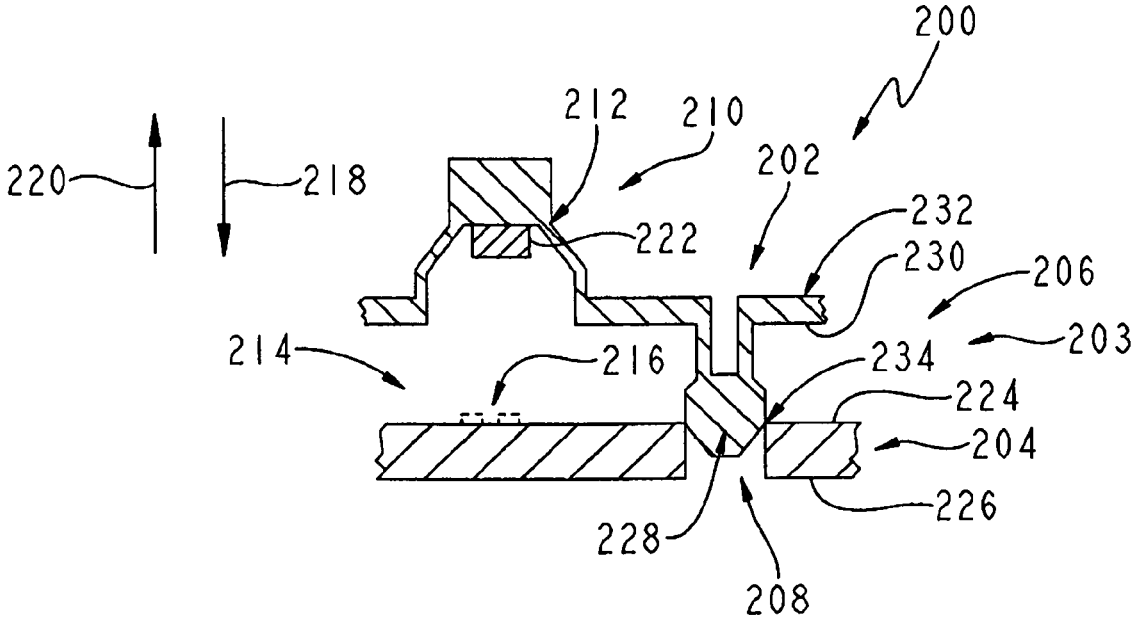
FIG. 2A is a representative view of an alignment feature, a push-through detail, of a switch pad being partially received within an alignment aperture of a circuit board.

Referring to FIG. 2A, switch pad 202 includes an alignment feature 206, illustratively a push-through detail, which is to be received by an alignment aperture 208 of circuit board 204. Alignment feature 206 cooperates with alignment aperture 208 to register a moveable portion 210, illustratively a switch dome 212, of switch pad 202 relative to a predefined portion 214 of circuit board 204, illustratively switch contact 216. Switch dome 212 is movable in directions 218, 220 and biased in direction 220 to an non-collapsed configuration shown in FIG. 2A. When in the non-collapsed configuration, a conductive member 222 of switch dome 212 is not in electrical contact with switch contact 216. When moved in direction 218, conductive member 222 may be brought into electrical contact with switch contact 216.

In one embodiment, switch pad 202 is made from a flexible material. In one example, switch pad 202 is made from silicon rubber. The flexible nature of switch pad 202 allows switch dome 212 to be moveable between a non-collapsed configuration and a collapsed configuration. In one embodiment, a flexible alignment feature 206 is received in alignment aperture 208 of circuit board 204. Alignment feature 206 and alignment aperture 208 cooperate to position switch dome 212 relative to switch contact 216.

Figure 2B:
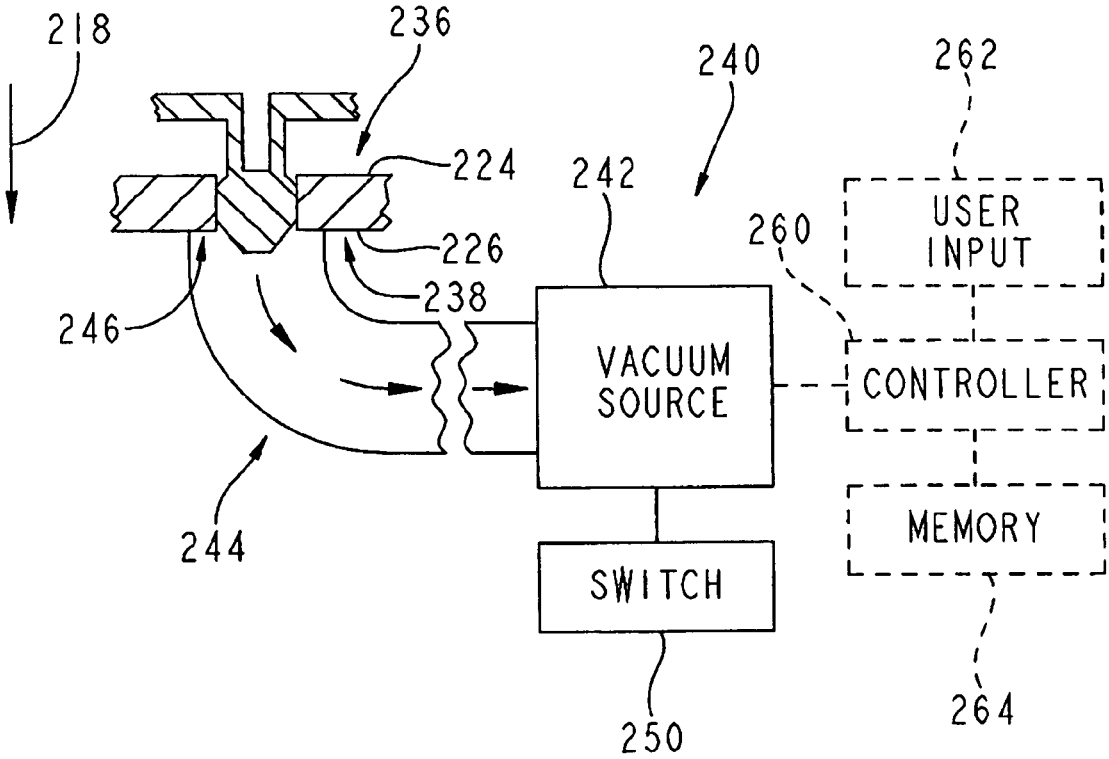
FIG. 2B is a representative view of a vacuum source being in fluid communication with a second side of the circuit board to reduce the pressure on the second side of the circuit board and advance the alignment feature further into the alignment aperture.
Figure 2C:
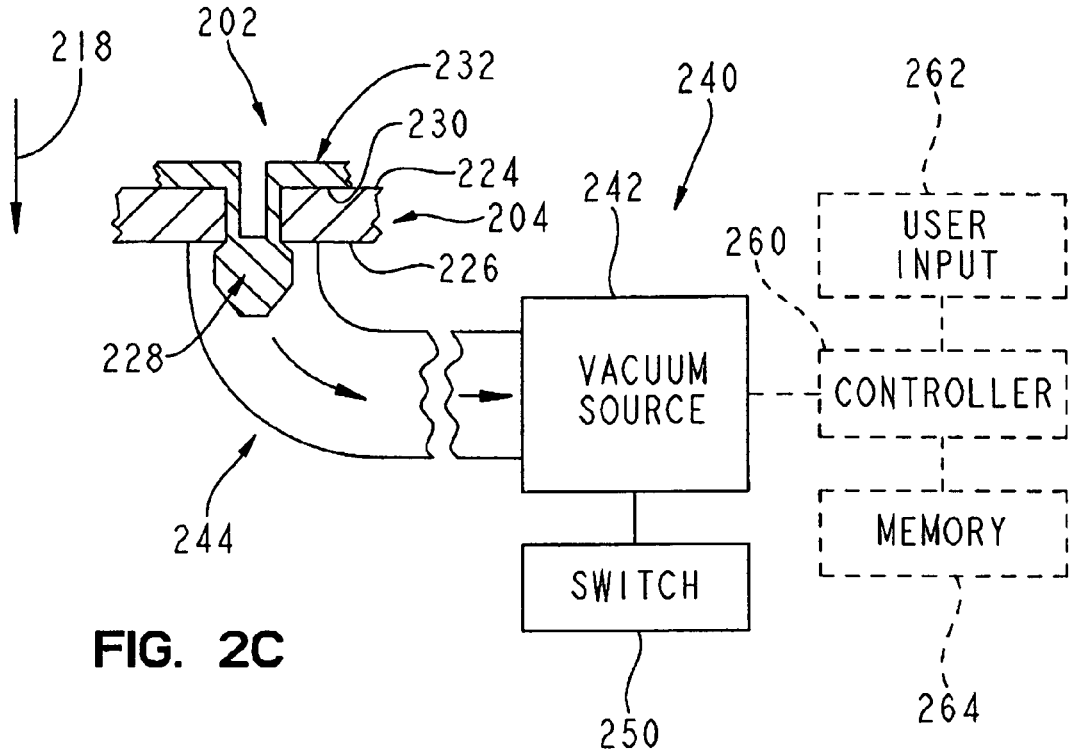
FIG. 2C is a representative view of the arrangement shown in FIG. 2B wherein the switch pad is fully seated relative to the circuit board.

In one embodiment, alignment feature 206 is introduced into alignment aperture 208 from a first side 236 of circuit board 204 adjacent first surface 224 of circuit board 204 and when assembled an end portion 228 extends beyond a second surface 226 of circuit board 204 as shown in FIG. 2C. As shown in FIG. 2C, alignment feature 206 is fully seated relative to alignment aperture 208. In FIG. 2C, alignment feature 206 is fully seated relative to alignment aperture 208 when end portion 228 of alignment feature 206 extends beyond second surface 226 of circuit board 204 and/or when a base portion 232 of switch pad 202 is brought generally into contact with first surface 224 of circuit board 204. Although alignment feature 206 is illustrated as a push-through detail having an enlarged diameter end portion 228, other suitable alignment features may be used including pull-through details or other types of locators.

Figure 3:
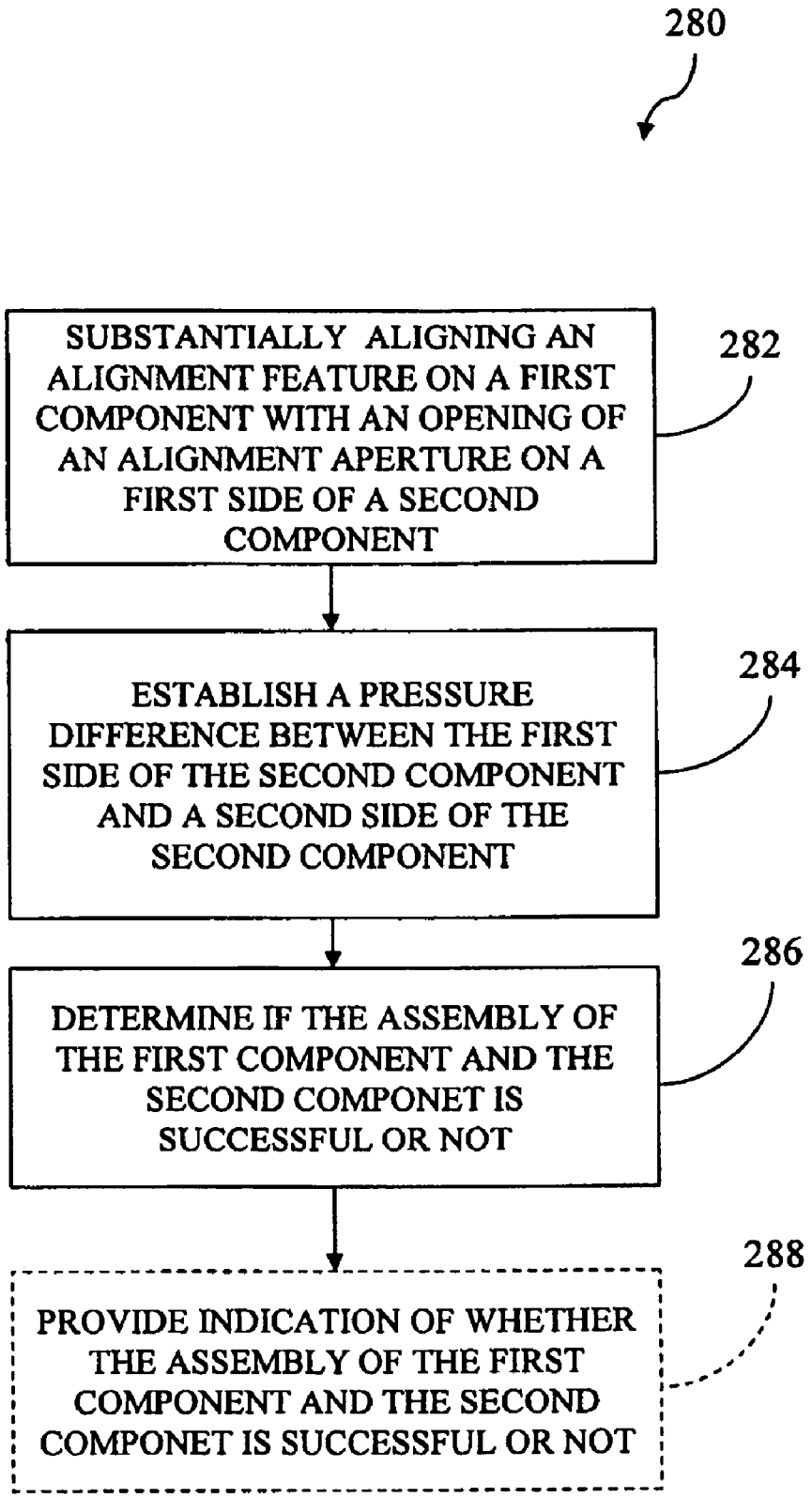
FIG. 3 is an exemplary method of assembling a first component including an alignment feature and a second component including an alignment aperture.

Referring to FIGS. 2A-2C and 3, an exemplary method 280 for assembling first component 200, illustratively switch pad 212, and second component 203, illustratively circuit board 204, is illustrated. Referring to FIG. 3, alignment feature 206 of switch pad 202 is substantially aligned with alignment aperture 208 of circuit board 204, as represented by block 282. In one embodiment, alignment feature 206 is substantially aligned with alignment aperture 208 when alignment feature 206 is at least partially received in alignment aperture 208, as shown in FIG. 2A. In another embodiment, alignment feature 206 is substantially aligned with alignment aperture 208 when alignment feature 206 is not at least partially received within alignment aperture 208 but is within about 0.5 millimeters of an opening 234 of alignment aperture 208. In another embodiment, alignment feature 206 is substantially aligned with alignment aperture 208 when alignment feature 206 is not at least partially received within alignment aperture 208 but is within about 1.0 millimeters of an opening 234 of alignment aperture 208.

Once alignment feature 206 is substantially aligned with alignment aperture 208, a pressure difference is established between first side 236 and second side 238 of circuit board 204, as represented by block 284 in FIG. 3. Referring to FIG. 2B, in one embodiment, a pressure difference between first side 236 and second side 238 is established by bringing a pressure source 240, illustratively a vacuum source 242, into fluid communication with second side 238 of circuit board 204 through a fluid conduit 244. Vacuum source 242 reduces the pressure in fluid conduit 244 and hence reduces the pressure adjacent a portion 246 of second side 238 of circuit board 204. In another embodiment, the pressure difference may be established by various methods resulting in the pressure adjacent second side 238 being lower than the pressure adjacent first side 236.

As shown in FIG. 2B, the reduction in pressure results in the advancement of alignment feature 206 in direction 218 wherein alignment feature 206 is further received by alignment aperture 208. Alignment feature 206, if properly aligned with alignment aperture 208, will continue to advance in direction 218 until alignment feature 206 is fully seated relative to alignment aperture 208 as shown in FIG. 2C.

Figure 2D:
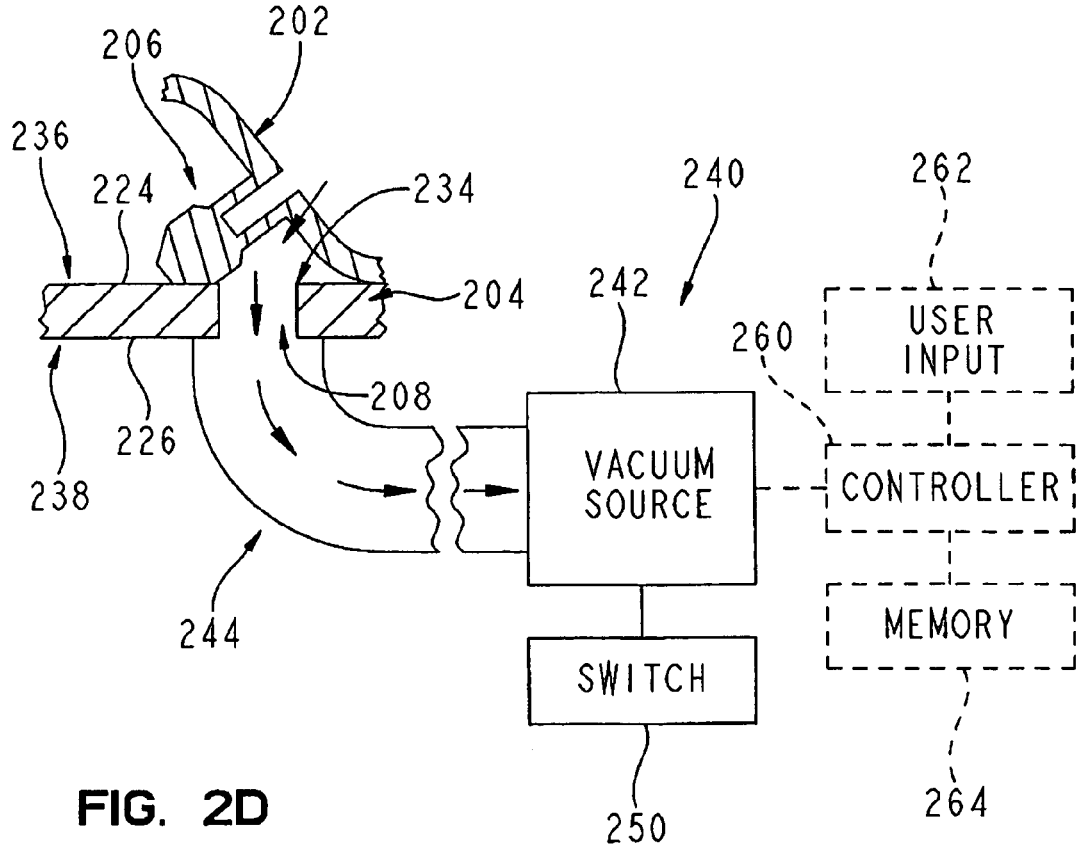
FIG. 2D is a representative view of an alignment feature misaligned relative to an alignment aperture.

Referring to FIG. 2D, an example of a non-successful assembly of switch pad 202 and the circuit board 204 is shown. As shown in FIG. 2D, alignment feature 206 is not advanced through alignment aperture 208. Rather, alignment feature 206 is misaligned relative to alignment aperture 208. Due to alignment feature 206 not being positioned in alignment aperture 208 a leak is present allowing vacuum source 242 to continue to draw air from first side 236 of circuit board 204 through alignment aperture 208. As is known, switch pads 202 typically include one or more apertures through which air may be communicated to alignment aperture 208, such as apertures for lights or other components. Thus, the pressure difference between first side 236 of circuit board 204 and second side 238 of circuit board 204 will be less if the non-successful assembly shown in FIG. 2D occurs instead of the successful assembly shown in FIG. 2C.

In one embodiment, vacuum source 242 is a connection to a vacuum pump, such as a valve which is moveable between an open or activated configuration to activate the reduction of pressure in fluid conduit 244 and a closed or deactivated configuration to deactivate the reduction of pressure in fluid conduit 244. In one embodiment, a central vacuum pump is provided and multiple applications including the applications described herein are connected to the central vacuum pump. In one example, vacuum source 242 attempts to draw the pressure adjacent second side 238 of circuit board 204 down to about 25 inches of Hg to draw alignment features 206 through alignment apertures 208 when alignment features 206 are substantially aligned with alignment apertures 208. In another embodiment, vacuum source 242 is a vacuum pump generally dedicated to the assembly of alignment feature 206 and alignment aperture 208 and may be activated or deactivated through a valve or through the provision or withholding of power to the vacuum pump.

Returning to FIG. 3, a determination is made regarding if the assembly of first component 200 and second component 203 is successful or non-successful, as represented by block 286. In one embodiment, this determination is made by an operator based upon one or more cues, such as visual cues and/or audible cues. In another embodiment, this determination is made by a controller 260.

Vacuum source 242, in one embodiment, is activated and deactivated through a user-operated control 250. In this embodiment, the user through audible cues and/or visual cues determines if the assembly of alignment feature 206 and alignment aperture 208 is successful or non-successful and hence whether the assembly of the first component 200 and the second component 203 is successful or non-successful.

Exemplary audible cues include a whistling sound generated by a leak between the switch pad 202 and circuit board 204 or a buzzer activated by controller 260 when the alignment feature 206 is not properly assembled relative to the alignment aperture 208 and the absence of a whistling sound between the switch pad 202 and circuit board 204 or a chime, tone, or beep activated by controller 260 when alignment feature 206 is properly assembled to alignment aperture 208. Exemplary visual cues include a reading on a pressure gauge in fluid communication with fluid conduit 244 to determine if first component 200 is successfully assembled relative to second component 203 or not. If the assembly of first component 200 and second component 203 is successful, a reading on the pressure gauge will be lower relative to a reading on the pressure gauge if the assembly of first component 200 and second component 203 is non-successful. This is because if the assembly is successful alignment feature 206 is fully seated relative to alignment aperture (FIG. 2C) and air may not be as easily drawn from first side 236 of circuit board 204 as when there is a misalignment between alignment feature 206 and alignment aperture 208 (FIG. 2D). In another embodiment, the operator may visually inspect switch pad 202 and circuit board 204 to determine if switch pad 202 is properly assembled to circuit board 204.

In another embodiment, controller 260 activates vacuum source 242 in response to a user input 262 and deactivates vacuum source 242 at the end of a test cycle, such as the expiration of a timer, or when a proper assembly of first component 200 and second component 203 is detected. A proper assembly of first component 200 and second component 203 may be detected in various ways including sensing that a threshold pressure, such as about 25 inches of Hg, has been reached in fluid conduit 244, vacuum source 242 is not drawing any further, and/or by a media insertion sensor which monitors the region below alignment aperture 306 to detect the presence of end portion 228 of alignment feature 206. Exemplary media insertion sensors may be optical or mechanical.

Figure 4:
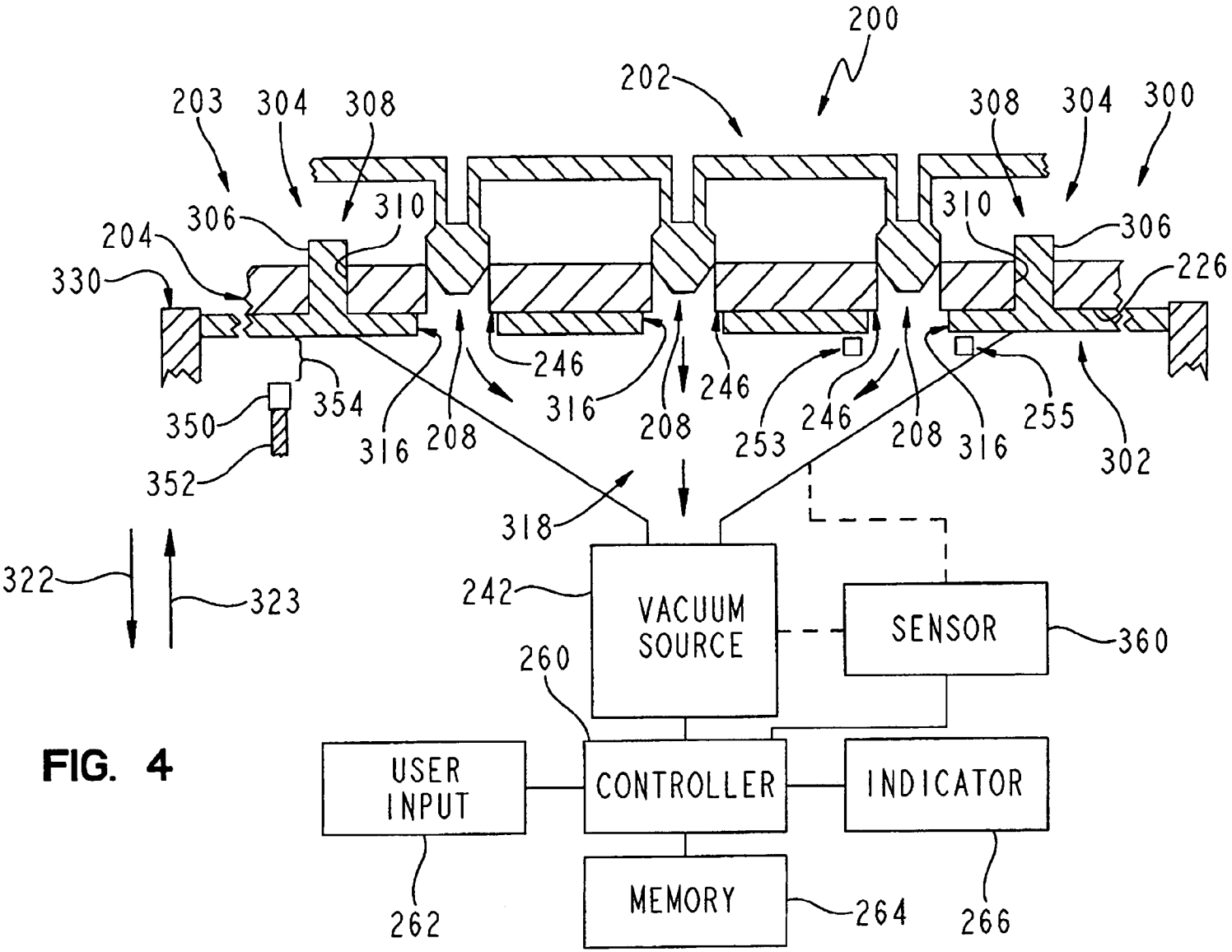
FIG. 4 is a representative view of an apparatus which assembles a switch pad to a circuit board and tests the alignment of the switch pad relative to the circuit board.

An exemplary optical sensor is a photo interrupter which includes an emitter 253 (FIG. 4) and a receiver 255 (FIG. 4). Radiation is emitted by emitter 253 and is detected by receiver 255 in the absence of the presence of alignment feature 206 there between. When alignment feature 206 is there between alignment feature 206 blocks the radiation from reaching receiver 255 thereby indicating the presence of alignment feature 206. Exemplary optical interrupters are Model Nos. RP-392 and RP-576 available from Rohm located at 21, Saiin Mizosaki-cho, Ukyo-ku, Kyoto 615-8585, Japan. An exemplary mechanical sensor is a detector switch, such as the SPVE series, available from Alps whose US headquarters are located at 910 E. Hamilton Avenue, Suite #500, Campbell, Calif. 95008.

In one embodiment, if a proper assembly of first component 200 and second component 203 has not been detected and the test cycle timer has expired, controller 260 determines that the assembly of the first component and the second component is non-successful. In one embodiment, based on the determination of whether the assembly of first component 200 and second component 203 was successful or non-successful, controller 260 provides an indication of whether the assembly of first component 200 and second component 203 was successful or non-successful, as represented by block 288 in FIG. 3. Exemplary types of indications for successful assemblies and non-successful assemblies are provided herein. Further, controller 260 may require additional processing of a non-successful assembly prior to permitting additional pairs of first component 200 and second components 203 to be assembled, such as documentation of the failure as described herein.

In another embodiment, the operator may observe whether the assembly of first component 200 and second component 203 is successful or non-successful based on audible cues and/or visual cues. Further, the deactivation of vacuum source 242 prior to the expiration of the test cycle timer may also provide an indication of a successful assembly of first component 200 and second component 203.

Exemplary controllers 260 include a processor or other electrical controller, such as a computer, or other suitable controllers. In one embodiment, controller 260 is configured to execute software instructions related to the methods of operation described herein. Exemplary user inputs 262 include a keyboard, a button, a touch screen, a switch, or other suitable input.

Referring to FIG. 4, a representation of an exemplary apparatus 300 is shown. Apparatus 300 is used to assemble first component 200, illustratively switch pad 202, and second component 203, illustratively circuit board 204. Apparatus 300 includes a holder 302 which holds circuit board 204 while switch pad 202 is assembled thereto. Holder 302 includes one or more locators 304, illustratively pins 306, which engage locators 308, illustratively apertures 310, on circuit board 204. By placing pins 306 in locator apertures 310 in circuit board 204, alignment apertures 208 in circuit board 204 are properly registered with apertures 316 of holder 302. Apertures 316 are in fluid communication with vacuum source 242 through fluid conduit 318. Fluid conduit 318 is shown as a single conduit that communicates with multiple apertures 316, illustratively three apertures. However, fluid conduit 318 may include a plurality of fluid conduits each in fluid communication with one or more apertures 316.

When vacuum source 242 attempts to reduce the pressure in fluid conduit 318, this reduction in pressure is communicated through apertures 316 to portions 246 of circuit board 204. Portions 246 include respective alignment apertures 208. Thus, the reduction in pressure is communicated to alignment apertures 208 and results in the substantially aligned alignment features 206 being advanced in direction 322.

In one embodiment holder 302 is made from a generally rigid material, such as G10 fiberglass, polycarbonates, ABS, or other suitable rigid materials. Holder 302 is removably coupled to a housing 330 and is configured for the arrangement of alignment apertures 208 and locator apertures 310 present on circuit board 204. Therefore, apparatus 300 may be configured to assemble a plurality of different switch pad 202 and circuit board 204 combinations by the coupling of various holders 302 to housing 330. In another embodiment, shown in FIG. 7, a holder 340 includes a first generally rigid portion 342 which supports circuit board 204 and a second generally moveable portion 344 which permits the first generally rigid portion 342 to move in directions 322 and 323. In one embodiment, moveable portion 344 is an expandable portion. Rigid portion 342 is generally similar to holder 302 and includes apertures 316 and locator pins 306. Vacuum source 242, controller 260, user input 262, sensor 360, and indicator 266 are shown outside of housing 330 in FIG. 7, however one or more of these components may be contained within housing 330.

Figure 6:
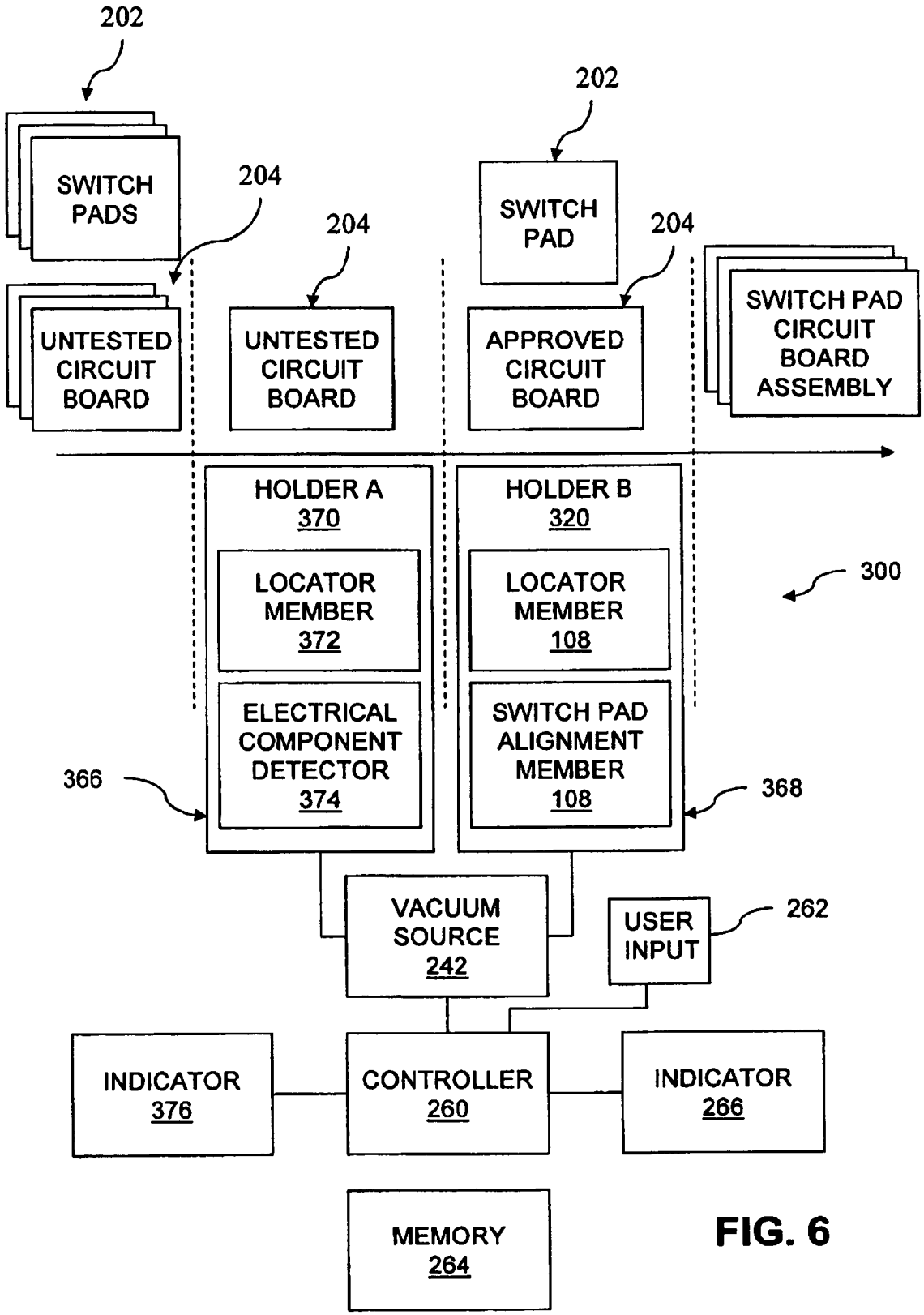
FIG. 6 is a representative view of an apparatus which assembles a switch pad to a circuit board, tests the alignment of the switch pad relative to the circuit board, and tests for component presence on the circuit board.
Figure 7:
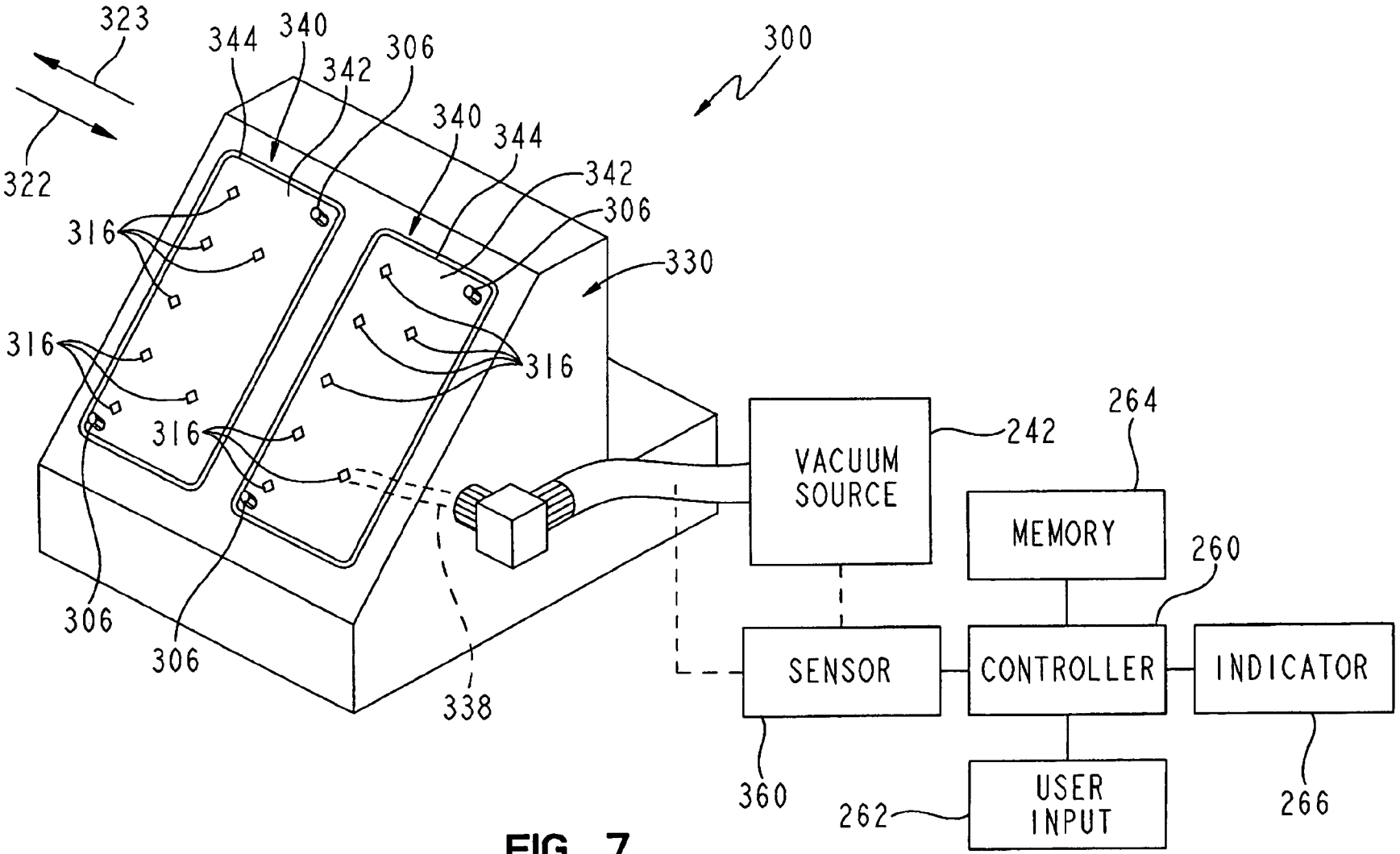
FIG. 7 is a representative view of an exemplary apparatus which assembles a switch pad to a circuit board, tests the alignment of the switch pad relative to the circuit board, and which may test for component presence on the circuit board.

Two holders 340 are shown in FIG. 7. Each holder may be operated simultaneously to assemble a given switch pad 202 to a respective circuit board 204. Further, in one embodiment, a single holder 342 or holder 302 is provided along with holder 370 which is configured to test for electrical component presence. Holder 370 is discussed herein in connection with FIG. 6.

Vacuum source 242 is activated and deactivated by controller 260. In one embodiment, wherein vacuum source 242 is a connection to a vacuum line, controller 260 activates vacuum source 242 by opening a valve and deactivates vacuum source 242 by closing a valve. As explained herein, controller 260 is configured to execute instructions, such as software stored in a memory 264, at least to control the operation of vacuum source 242 and/or to determine if a given assembly of switch pad 202 to circuit board 204 is successful or non-successful.

In the embodiment illustrated in FIG. 4, controller 260 is further coupled to an indicator 266. Indicator 266 provides a first indication if the assembly of switch pad 202 and circuit board 204 is successful and a second indication if the assembly of switch pad 202 and circuit board 204 is non-successful. In one embodiment, indicator 266 includes a light having a first color, such as red, to indicate a non-successful assembly of switch pad 202 and circuit board 204 and a second color, such as green, to indicate a successful assembly of switch pad 202 and circuit board 204. An exemplary light is a bi-color light emitting diode. In another embodiment, two separate lights are used, one for successful assembly and one for non-successful assembly. In a further embodiment, a message or other indicator is presented on a display screen (not shown), the message being tailored based on whether the assembly was successful or non-successful, such as a first message for a successful assembly and a second message from a non-successful assembly. In yet another embodiment, apparatus 300 does not include indicator 266, but rather the indication of success of the assembly is gauged by the operator from the audible and/or visual cues discussed herein.

Figure 5:
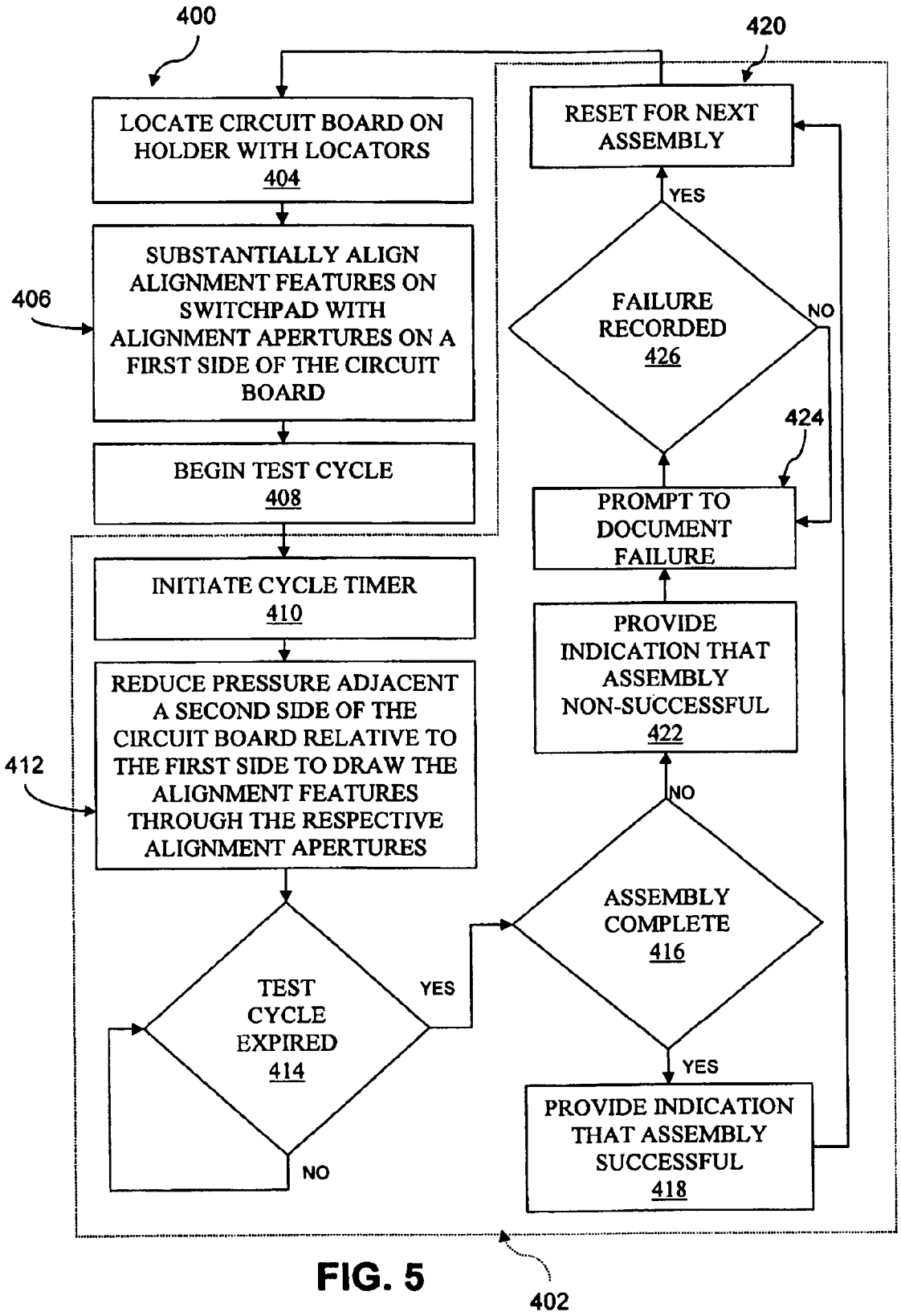
FIG. 5 is an exemplary method of assembling a first component including an alignment feature and a second component including an alignment aperture.

Referring to FIG. 5, an exemplary method 400 for assembling switch pad 202 to circuit board 204 is illustrated. In one embodiment, the portion of method 400 within the dotted region 402 is performed through instructions executed by controller 260. As represented by block 404, circuit board 204 is located on holder 320 or holder 340 with locators 304 of the respective holder 320 or holder 340 and locators 308 of circuit board 204. It is assumed that holder 320 or holder 340 is configured for circuit board 204. If not, the current holder 320 or holder 340 should be replaced with a different holder 320 or holder 340 that is configured for circuit board 204. Once circuit board 204 is located relative to holder 320 or holder 340, alignment apertures 208 in circuit board 204 are generally within the periphery of apertures 316 of the respective holder 320 or holder 340.

As represented by block 406, alignment features 206 of switch pad 202 are substantially aligned with the respective alignment apertures 208 of circuit board 204. The operator begins the test cycle wherein alignment features 206 are advanced through alignment apertures 208 by providing a user input, such as with user input 262, as represented by block 408.

Controller 260 receives an indication of the user input and initiates a test cycle timer, as represented by block 410. In one embodiment, the test cycle timer defines the length of time apparatus 300 attempts to assemble switch pad 202 and circuit board 204. In one example, test cycle timer has a duration of about 3 seconds. In another example, test cycle timer has a duration of about 4 seconds. In a further example, test cycle timer has a duration of up to about 3 second or up to about 4 seconds. In general, vacuum source 242 is capable of assembling switch pad 202 to circuit board 204 in about 1 second to about 2 seconds.

Controller 260 further activates vacuum source 242 to reduce the pressure in fluid conduit 318 and hence the pressure adjacent the second side of circuit board 204 to draw alignment features 206 through respective alignment apertures 208, as represented by block 412. Controller 260 continues have vacuum source 242 activated until the test cycle timer expires, as represented by block 414. Controller 260 further determines if the assembly of switch pad 202 to circuit board 204 was successful as described herein and as represented by block 416.

The determination of whether the assembly of switch pad 202 to circuit board 204 was successful may be made by various methods. The following discussion lists several exemplary methods of determining whether the assembly of switch pad 202 to circuit board 204 was successful. These exemplary methods may be combined or used independently.

In one embodiment, the determination is based on monitoring a parameter of vacuum source 242, such as a pressure in the vacuum line connected to fluid conduit 318. In another embodiment, the determination is based on monitoring the pressure in fluid conduit 318. In one example, the pressure in fluid conduit 318 or in vacuum source 242 is measured with a pressure sensor 360. In still another embodiment, the determination is made based on a media insertion sensor 253, 255 which monitors whether end portion 228 of alignment features 206 extends below second surface 226 of circuit board 204.

In a further embodiment, a portion of holder 320, like portion 342 of holder 340, is movable in direction 322 and the determination of whether the assembly of switch pad 202 to circuit board 204 is successful is based on the position of holder 320. For instance, assuming that the portion of holder 320 which supports circuit board 204 is moveable in direction 322, a reduction of pressure in fluid conduit 318 would generally advance alignment features 206 in direction 322 until alignment features 206 are fully seated followed generally by the movement of the moveable portion of holder 320 in direction 322. As such, sensor 350, such as a detector switch, may be positioned below holder 320 to detect when holder 320 has moved in direction 322 a distance equal to gap 354 between sensor 350 and holder 320. As illustrated in FIG. 4, sensor 350 may be positioned on top of standoff 352 which limits the movement of holder 320 in direction 322. Exemplary detector switches include the SPVE series, available from Alps Returning to FIG. 5, if the assembly of switch pad 202 and circuit board 204 is successful controller 260 provides an indication that the assembly was successful, as represented by block 418. Exemplary indications are described herein and include a visual cue, such as a light, and an audible or tactical cue, such as deactivating vacuum source 242.

Controller 260 further resets for the next assembly, as represented by block 420. In one embodiment, controller 260 resets for the next assembly by resetting the cycle timer. In another embodiment, controller 260 resets for the next assembly by resetting the cycle timer and deactivating vacuum source 242. Regardless, of whether the deactivation of vacuum source 242 is an indication of the assembly being successful, controller 260 deactivates vacuum source 242 once the determination has been made whether the assembly of switch pad 202 and circuit board 204 is successful or non-successful.

If the determination is made that the assembly of switch pad 202 and circuit board 204 is non-successful, controller 260 provides an indication that the assembly is non-successful, as represented by block 422. Exemplary indications are described herein and include a visual cue, such as a light or display on a display screen, and an audible or tactile cue, such as a buzzer. In one embodiment, controller 260 is configured to permit the determination that the assembly of switch pad 202 and circuit board 204 is successful to be made prior to the expiration of the test cycle timer. As such, the expiration of the test cycle timer may be a method of determining that the assembly of switch pad 202 and circuit board 204 is non-successful.

Once a non-successful assembly has been detected, controller 260 prompts the operator to document the failure, as represented by block 424, and deactivates vacuum source 242. Controller 260 may prompt the operator to document the failure by providing an indication, such as a visual cue and/or an audible cue. In one embodiment, controller 260 provides a message on a display screen (not shown) prompting the user to document the failure. In one embodiment, the failure is documented by the user scanning a bar code on at least one of circuit board 204 and switch pad 202 and providing or selecting a textual description of the reason for failure. Exemplary reasons for failure include switch pad 202 is missing an alignment feature 206, circuit board 204 is missing an alignment aperture 208, or one of the alignment features 206 is misaligned relative to the corresponding alignment aperture 208, such as shown in FIG. 3D.

Controller 260 checks to see if the failure has been properly documented, as represented by block 426. In one embodiment, controller 260 checks to see if the operator has provided the requested information. If the failure has not been properly documented, the operator is once again prompted to properly document the failure, as represented by block 424. If the failure has been properly documented, controller 260 resets for the next assembly, as represented by block 420. In one embodiment, controller 260 prevents the activation of vacuum source 242 until the prior failed assembly has been properly documented. In one embodiment, controller 260 resets for the next assembly by resetting the cycle timer and permitting vacuum source 242 to be activated.

Referring to FIG. 6, in one embodiment, apparatus 300 may include an in-circuit tester stage 366 and an assembly stage 368. In-circuit tester stage 366 operates generally similar to known in-circuit testers, such as Z18 XX series available from Terradyne. In-circuit tester stage 366 checks for the presence of electrical components on circuit board 204. Assembly state 368 operates according to the disclosed methods and configurations contained herein for assembling switch pad 202 and circuit board 204 and making a determination whether the assembly thereof was successful or non-successful.

Starting at the left side of FIG. 6, a plurality of switch pads 202 and a plurality of untested circuit boards 204 are provided. Untested circuit boards 204 may have been previously tested for various parameters, but still need to be tested for the presence of various electrical components. An operator selects a first untested circuit board and places it on a holder 370 of in-circuit tester stage 366. Holder 370 includes locator member 372 to properly orient circuit board 204, generally similar to locator members 304 of holder 320. Controller 260, in response to a user input with user input 262, activates vacuum source 242.

Holder 370 uses the design of circuit board 204 to provide a sealing surface in non-component areas to allow vacuum source 242 to pull down on circuit board 204. Vacuum source 242 reduces the pressure on a bottom side of a first portion of holder 370 (similar to first portion 342 of holder 340) which causes the first portion of holder 370 to move downward against the bias of a plurality of spring members (not shown). The movement of holder 370 is limited by hard stops (not shown) which prevent further downward movement of holder 370. As holder 370 moves downward, an electrical component detector 374, such as pins, contact portions of circuit board 204 and based on the electrical characteristics monitored by these pins, controller 260 is able to determine if the appropriate electrical component is present or not. Controller 260 deactivates vacuum source 242 and provides an indication with an indicator 376 to the operator of whether the untested circuit board passed the electrical component presence test or not. Exemplary indicators include visual indicators, such as one or more lights or messages on a display, and audible or tactile indicators, such as a buzzer, chime, tone, or beep.

In one embodiment, if the untested circuit board did not pass the electrical component presence test, controller 260 prompts the operator to document the reasons for the failure. Similar to the stand alone assembly test apparatus described in connection with FIG. 4, controller 260 prevents activation of vacuum source 242 until the failure has been properly documented.

Assuming circuit board 204 is approved, the approved circuit board 204 is positioned on holder 320 (or holder 340) of assembly stage 368 as described herein. Switch pad 202 is substantially aligned with the approved circuit board 204 positioned on holder 320 as described herein. In one embodiment, holder 320 is generally rigid. In another embodiment, a portion of holder 320 is moveable in direction 342 similar to holder 340. In the case wherein a portion of holder 320 is moveable, a perimeter seal may be provided for fluid conduit 338 around the portions of holder 320 which include apertures 316. Further, supports may be provided at points in proximity to alignment features 206 as they pass through alignment apertures 208 of circuit board 204.

Controller 260 receives an input with user input 242 to assemble and test the assembly of switch pad 202 and approved circuit board 204. Controller 260 executes one of the methods disclosed herein to test whether the assembly of switch pad 202 and the approved circuit board 204 is successful or non-successful. While controller 260 is assembling and testing the assembly of switch pad 202 and approved circuit board 204, controller 260 may be simultaneously or in successive order be testing a second untested circuit board with in-circuit stage 366.

If the assembly of switch pad 202 and approved circuit board 204 is successful then the assembly is moved on for further processing. If the assembly of switch pad 202 and approved circuit board 204 is non-successful then the operator provides documentation of the failure as described herein. It should be understood that assembly stage 368 may proceed in-circuit tester stage 366.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A method of assembling a first component and a second component, including the steps of:

providing a flexible first component including a first portion moveable between a first position and a second position and a flexible alignment feature, and a second component including a predefined portion and an alignment aperture through the second component, wherein the flexible alignment feature of the first component and the alignment aperture of the second component cooperate to register the first portion of the flexible first component relative to the predefined portion of the second component, said flexible alignment feature comprising an end portion;

substantially aligning the flexible alignment feature and the alignment aperture, wherein the end portion of the flexible alignment feature is positioned at least proximate to the alignment aperture relative to a first side of the second component;

generating a pressure difference between the first side of the second component and a second side of the second component at least proximate to the alignment aperture thereby to move the end portion of the flexible alignment feature into and through the alignment aperture such that the end portion extends beyond the second side of the second component, fully seating the flexible alignment feature relative to the alignment aperture. wherein generating the pressure difference includes bringing a vacuum source into fluid communication with an opening of the alignment aperture on the second side of the second component and activating the vacuum source resulting in the pressure adjacent the second side of the second component being reduced relative to the pressure on the first side of the second component; and deactivating the vacuum source to discontinue the pressure difference, whereupon said end portion remains extended beyond the second side and engages the second side to secure the flexible first component to the second component.

2. The method of claim 1, wherein the first portion of the first component is a switch including a flexible dome member and a conductive member and the predefined portion of the second component includes a first electrical contact and a second electrical contact.

3. The method of claim 2, wherein the conductive member of the switch is spaced apart from the first electrical contact and the second electrical contact of the predefined portion of the second component when the switch is in the first position and the conductive member of the switch electrically connects the first electrical contact and the second electrical contact of the predefined portion of the second component when the switch is in the second position.

4. The method of claim 3. wherein the generating step results in the switch being biased towards the first position.

5. The method of claim 1, further comprising the step of providing a first indication that the flexible alignment feature is fully seated relative to the alignment aperture.

6. The method of claim 1, further comprising the step of providing a second indication that the flexible alignment feature is misaligned relative to the alignment aperture.

7. The method of claim 1, wherein the first component is a switch pad and the second component is a circuit board.

8. The method of claim 7. wherein when in the generating step the switch pad is fully seated relative to the circuit board a base portion of the switch pad is generally touching a first side of the circuit board.

* * * * *